US012054691B2

(12) United States Patent
Erkel et al.

(10) Patent No.: US 12,054,691 B2
(45) Date of Patent: Aug. 6, 2024

(54) POLYUREA LUBRICATING GREASES CONTAINING CARBONATES, AND THEIR USE

(71) Applicant: FUCHS SE, Mannheim (DE)

(72) Inventors: Hans Jürgen Erkel, Bruchmühlbach-Miesau (DE); Olaf Binkle, Kirkel (DE); Torsten Goerz, Hochspeyer (DE)

(73) Assignee: FUCHS SE, Mannheim (DE)

( * ) Notice: Subject to any disclaimer, the term of this patent is extended or adjusted under 35 U.S.C. 154(b) by 0 days.

(21) Appl. No.: 18/002,987

(22) PCT Filed: Jul. 1, 2021

(86) PCT No.: PCT/DE2021/100568

§ 371 (c)(1),
(2) Date: Dec. 22, 2022

(87) PCT Pub. No.: WO2022/002317

PCT Pub. Date: Jan. 6, 2022

(65) Prior Publication Data

US 2023/0257677 A1 Aug. 17, 2023

(30) Foreign Application Priority Data

Jul. 3, 2020 (DE) ..... 102020117671.6

(51) Int. Cl.

| | |
|---|---|
| ***C10M 169/04*** | (2006.01) |
| ***C10M 129/84*** | (2006.01) |
| ***C10N 20/02*** | (2006.01) |
| ***C10N 30/00*** | (2006.01) |
| ***C10N 40/02*** | (2006.01) |
| ***C10N 40/04*** | (2006.01) |
| ***C10N 50/10*** | (2006.01) |

(52) U.S. Cl.

CPC ..... *C10M 169/04* (2013.01); *C10M 129/84* (2013.01); *C10M 2203/003* (2013.01); *C10M 2207/1285* (2013.01); *C10M 2207/32* (2013.01); *C10M 2217/0456* (2013.01); *C10N 2020/02* (2013.01); *C10N 2030/36* (2020.05); *C10N 2040/02* (2013.01); *C10N 2040/04* (2013.01); *C10N 2050/10* (2013.01)

(58) Field of Classification Search

CPC ..... C10M 129/84; C10M 169/04; C10M 2202/003; C10M 2207/1285; C10M 2207/32; C10M 2217/0456; C10N 2020/02; C10N 2030/36; C10N 2040/02; C10N 2040/04; C10N 2050/10

See application file for complete search history.

(56) References Cited

U.S. PATENT DOCUMENTS

| | | | | |
|---|---|---|---|---|
| 4,298,481 | A | 11/1981 | Clarke | |
| 5,084,193 | A | 1/1992 | Waynick | |
| 5,207,935 | A * | 5/1993 | Waynick | C10M 169/00 508/158 |
| 6,172,013 | B1 | 1/2001 | Holt et al. | |
| 8,507,421 | B2 | 8/2013 | Zaki | |
| 10,066,186 | B2 | 9/2018 | DeSantis et al. | |
| 10,106,759 | B2 | 10/2018 | DeSantis et al. | |
| 2012/0281939 | A1* | 11/2012 | Nakamura | G01P 3/443 384/477 |
| 2015/0291906 | A1 | 10/2015 | DeSantis et al. | |
| 2015/0299608 | A1* | 10/2015 | Tsutsui | C10M 169/04 508/386 |
| 2016/0002560 | A1 | 1/2016 | DeSantis et al. | |

FOREIGN PATENT DOCUMENTS

| | | | | |
|---|---|---|---|---|
| CN | 107236581 | A * | 10/2017 | C10M 125/00 |
| CN | 107903987 | A * | 4/2018 | |
| CN | 107903987 | A | 4/2018 | |
| DE | 102007048091 | A1 | 6/2008 | |
| EP | 0508115 | A1 | 10/1992 | |
| EP | 0562062 | B1 | 1/1998 | |
| EP | 3374479 | A1 | 9/2018 | |
| JP | 2002-147472 | A | 5/2002 | |
| WO | 2011095155 | A1 | 8/2011 | |
| WO | 2012082285 | A1 | 6/2012 | |

OTHER PUBLICATIONS

English-language machine translation of Cn 107236581A (Year: 2017).*
WPI 2017 Clarivate Analytics.

* cited by examiner

*Primary Examiner* — James C Goloboy
(74) *Attorney, Agent, or Firm* — D'Ambrosio & Menon, PLLC; Usha Menon

(57) ABSTRACT

The invention relates to polyurea lubricating grease compositions containing polyurea thickeners and at least one organic carbonate, to lubrication points or components containing the polyurea lubricating grease composition, to a seal comprising sealing material from fluorinated elastomers and to the use of the lubricating greases.

23 Claims, No Drawings

POLYUREA LUBRICATING GREASES CONTAINING CARBONATES, AND THEIR USE

The object of the invention are polyurea lubricating grease compositions containing polyurea thickeners and at least one organic carbonate, lubrication points or components, respectively, containing the polyurea lubricating grease constituents, and a seal comprising a sealing material of fluorinated elastomers, and the use of the lubrication greases.

INTRODUCTION AND PRIOR ART

For tribosystems, as they are used in many technical applications, it is important to use lubricants to reduce the friction and the wear at the contact surfaces of movable parts. Depending on the area of application, lubricants of a different consistency can be used thereby. Lubricating oils have a liquid consistency, which is capable of flow, while lubricating greases have a semi-solid to solid—often gel-like—consistency.

A characteristic of a lubricating grease is that a liquid oil component is absorbed and held by a thickener component. The paste-like nature of a lubricating grease and its property of being spreadable and easily plastically deformable, together with the property of being adhesive, ensures that the lubricating grease wets the lubrication point, and the lubricating effect develops at the tribologically stressed surfaces. In addition to additives, lubricating greases essentially comprise a thickening agent, which is present to be distributed in a base oil.

The consistency or its yield point, respectively, the avoidance of post-curing and excessive oil separation under thermal and mechanical stress as well as a stable viscosity temperature behavior and viscosity shear behavior are among the most important rheological properties of a lubricating grease. A high level of practical experience is necessary to create a lubricating grease of a high use value depending on the application requirements.

Lubricating greases are often used in encapsulated or sealed environments, in order to protect the lubrication point against water, to minimize lubricating grease losses, and to avoid the ingress of particles, such as sand or dust. Typical applications for lubricating greases are the lubrication of ball bearings, sliding bearings, gearboxes, or constant velocity drive shafts.

Polyurea lubricating greases are often used for lubrication points, which are subject to high temperatures and/or aggressive environments. When sealing materials are used under such conditions of use, fluorinated elastomers are often resorted to, which are thermally and chemically particularly resilient, with regard to the selection of the sealing material. The combination of such a lubricating grease/sealing material pairing is often limited because the fluorinated elastomers tend to cure or even become brittle in the presence of the polyurea lubricating greases.

Various additives for improving the compatibility with fluorinated elastomers have already been proposed. Examples for this are EP0562062 B1, WO2012082285 A1; U.S. Ser. No. 10/106,759; U.S. Ser. No. 10/066,186; U.S. Ser. No. 10/106,759; US20150291906 A1; U.S. Ser. No. 10/066,186, US20160002560 A1, and EP3374479 A1.

Carbonates, such as ethylene carbonate (CN107903987 A) or propylene carbonate (U.S. Pat. No. 4,298,481 A) are known as activator/dispersant in lubricating greases for inorganic thickeners, but not as additive for polyurea thickeners

Object of the Invention

It is the object of the present invention to improve the useful properties of polyurea lubricating greases, e.g., with regard to consistency, shear stability, and period of use, and the lubricating grease is to in particular not post-cure or post-cure only as little as possible, respectively. Polyurea lubricating greases are to furthermore be provided, which have an improved compatibility with fluorinated elastomers, as they are used as sealing materials, wherein the lubricating grease is to not be negatively influenced in its useful properties by possible additives for increasing the compatibility with fluorinated elastomers.

SUMMARY OF THE INVENTION

The object is solved by means of the subject matter of the independent claims. Preferred embodiments are subject matter of the subclaims or will be described below.

The polyurea grease composition according to the invention comprises:

a) a base oil (optionally comprising a base oil mixture) in a quantity of 55 to 95% by weight and preferably 70 to 90% by weight;

b) at least one polyurea thickener in a quantity of 1 to 20% by weight, preferably 1.5 to 15% by weight;

c) at least one inorganic carbonate, wherein the organic carbonate comprises 4 to 8 carbon atoms in a quantity of 0.1 to 10% by weight, preferably 0.2 to 5% by weight, particularly preferably 0.5 to 2% by weight.

Beyond c), additives, such as the following, can furthermore be used:

d) at least one additive, preferably in a quantity of 0.5 to 40% by weight and in particular 2 to 10% by weight.

The polyurea grease composition optionally furthermore contains 1 to 20% by weight, preferably 1 to 15% by weight, of a thickener on the basis of a soap and/or complex soap thickener.

In the present case, mixed greases containing polyurea thickeners and soap and/or complex soap thickeners are also referred to as polyurea grease composition.

The terms polyurea grease composition and polyurea grease(s) are used synonymously below.

DETAILED DESCRIPTION OF THE INVENTION

Common lubricating oils, which are liquid at room temperature, are used as base oils. The base oil preferably has a kinematic viscosity of 20 to 2500 $mm^2/s$, in particular of 40 to 500 $mm^2/s$, in each case at 40° C.

The base oils can be classified as mineral oils or synthetic oils. For example, naphthenic mineral oils and paraffinic mineral oils are considered to be mineral oils according to the classification according to API group I. Chemically modified low-aromatic and low-sulfur mineral oils with a small portion of saturated compounds and a viscosity/temperature behavior that is improved compared to group I oils, classified according to API group II and III, are likewise suitable.

In particular polyethers, esters, polyalphaolefins, polyglycols, and alkyl aromatics and the mixtures thereof, as well as silicon oils are mentioned as synthetic oils. The polyether compound can have free hydroxyl groups but can also be completely etherified or end group etherified and/or can be made from a starting compound with one or several hydroxy and/or carboxyl groups (—COOH). Polyphenyl ethers, optionally alkylated, as sole components, or even better yet as mixed components, are also possible. Esters of an aromatic di-, tri-, or tetracarboxylic acid, with one or mixed C2 to C22 alcohols, esters of adipic acid, sebacic acid, trimethylopropane, neopentyl glycol, pentaerythritol, or dipentaerythritol with aliphatic branched or unbranched, saturated or unsaturated C2 to C22 carbonic acids, C18 dimer acid esters with C2 to C22 alcohols, complex ester, as individual components or in any mixture, can be used in a suitable manner.

The polyurea thickeners are organic thickening systems, which can be obtained by conversion of one or several amine components with one or several isocyanate components.

The educts for producing the polyurea thickener/thickeners are primary amines and isocyanates.

The amines are monoamine hydrocarbyl, di- or polyamine hydrocarbylene compounds. The hydrocarbyl or the hydrocarbylene groups preferably each have 6 to 20 carbon atoms, particular preferably 6 to 15 carbon atoms. The hydrocarbylene group preferably has aliphatic groups, these are in particular alkyl or alkylene groups. Suitable amines or suitable polyureas, respectively, are mentioned in EP 0508115 A1 from page 1, line 51, to page 16, bottom.

Mono- and/or polyisocyanates are suitable as isocyanate component, wherein the polyisocyanates are preferably hydrocarbons with two isocyanate groups. The isocyanates have 5 to 20, preferably 6 to 15 carbon atoms and preferably contain aromatic groups.

The amine component is either mono-, di- or multifunctional or the isocyanate component is mono-, di-, or multifunctional, or both.

According to an embodiment, the polyurea thickeners are available as reaction product of diisocyanates with C6 to C20 hydrocarbyl monoamines. However, the reaction products of monoisocyanates, optionally plus additionally diisocyanates, can also be present with diamines. The polyurea thickeners typically do not have a polymeric character, but are, e.g., dimers, trimers, or tetramers. In addition to the polyisocyanates, isocyanates of the type R-NCO (monoisocyanates) can thus also be used, wherein R represents a hydrocarbon radical with preferably 5 to 20 carbon atoms.

Preferred are diureas, which can be obtained from diisocyanates and monoamines, or tetraureas, which can be obtained from diisocyanates, monoamine, and diamine, in each case as defined above. In particular preferred are

- diureas on the basis of 4,4'-diphenylmethanediisocyanate (MDI) or toluene-2,4-diisocyanate (TDI) and aliphatic, aromatic and/or cyclic primary monoamines or
- tetraureas on the basis of MDI or TDI and aliphatic, aromatic and/or mono- and diamines.

The polyurea thickener is preferably produced by means of in-situ reaction of the amine and isocyanate component in the base oil.

Bentonites, such as montmorillonite (the sodium ions of which are optionally exchanged or partially exchanged, respectively, with organically modified ammonium ions), aluminosilicates, aluminum oxides, hydrophobic and hydrophilic silicic acid, can optionally be used additionally as inorganic thickeners, optionally together with oil-soluble polymers (e.g. polyolefins, poly(meth)acrylates, polyisobutylenes, polybutenes, or polystyrene copolymers) as co-thickeners.

The bentonites, aluminosilicates, aluminum oxides, silicic acid, amorphous silicon dioxide and/or oil-soluble polymers can be added for the production of the base grease or can be added later as additive in the second step. Preferably, no inorganic thickeners are used, in particular no bentonites, aluminosilicates, aluminum oxides, silicic acids, and amorphous silicon dioxide, in each case also individually.

In particular soap or complex soap thickeners on the basis of calcium, lithium, or aluminum salts are suitable as organic thickeners. The soap is available, e.g., as conversion product of, e.g., calcium hydroxide, lithium hydroxide, or aluminum alcoholate with a saturated or unsaturated monocarboxylic acid with 10 to 32 carbon atoms, in particular with 16 to 20 carbon atoms, optionally substituted, e.g., by hydroxy, as ester, or anhydride. Esterified dicarboxylic acid semi-amides (C12-C24) on the basis of the terephthalate acid can also be used. In the present case, the corresponding greases are also referred to as soap thickeners. Due to the presence of a complexing agent, the soap becomes complex soap. Suitable complexing agents are: (a) the alkaline salt (preferably lithium salt), alkaline earth salt (preferably calcium salt), or aluminum salt of a saturated or unsaturated monocarboxylic acid, or also hydroxycarboxylic acids with 2 to 8, in particular 2 to 4 carbon atoms, or a di-carboxylic acid with 2 to 16, in particular 2 to 12 carbon atoms, in each case optionally substituted, and/or (b) the alkaline or alkaline earth salt of the boronic acid and/or phosphorous acid, in particular the conversion products thereof with LiOH and/or $Ca(OH)_2$.

Simple, mixed, or complex soaps on the basis of Li, Na, Mg, Ca, Al, Ti salts and carboxylic acids or sulphonic acids can be added as additive during the base grease production or later. These soaps can alternatively also be formed in situ during the production of the greases.

Hydroxyaluminum benzoate stearates can be used, for example, to produce aluminum complex soap-thickened lubricating greases. Lithium 12-hydroxystearate thickeners are typical representatives of the lithium soap greases, calcium 12-hydroxystearates are representatives for calcium soap greases.

According to a preferred alternative, the polyurea thickener and the soap or complex soap thickeners are used together, wherein Ca soaps or Ca complex soaps, respectively, are particularly preferred, e.g., in a mixing ratio of 10:1 to 1:10, in particular 5:1 to 1:5 (in each case mass: mass). Soap or complex soap thickeners and polyurea thickeners are then preferably used together with 5 to 25% by weight with regard to the polyurea grease composition of claim 1, wherein at least 1% by weight of the polyurea thickener is used, preferably at least 1.5% by weight, in each case based on the polyurea grease composition.

For example, polymer powders, such as polyamides, polyimides, or PTFE, melamine cyanurate, graphite, metal oxides, boron nitride, silicates, e.g. magnesium silicate hydrate (talc), sodium tetraborate, potassium tetraborate, metal sulfides, such as, e.g., molybdenum sulfide, tungsten sulfide, or mixed sulfides on the basis of tungsten, molybdenum, bismuth, tin, and zinc, inorganic salts, for example of the alkaline and alkaline earth metals, such as, e.g., calcium carbonate, sodium and calcium phosphates, can be used as solid lubricants. Also carbon black or other carbon-based solid lubricants, such as, for example, nanotubes.

Lignin derivatives, such as alkaline or alkaline earth lignin sulfonates, in particular calcium lignin sulfonates, can likewise be used to attain specific properties, e.g., 2 to 15% by weight (according to WO2011095155A1 or U.S. Pat. No. 8,507,421 B2).

In the context of the present invention, it was surprisingly found that the addition of the claimed organic carbonates improves the useful properties of the polyurea lubricating greases according to the invention and that the compatibility of polyurea lubricating greases with fluorinated elastomers is improved by using organic carbonates.

The organic carbonates have 4 to 8 carbon atoms. The radicals or constituents of the organic carbonates are hydrocarbons (apart from the carbonate group itself), i.e., the organic carbonate is not heteroatom-substituted.

Cyclic carbonates, in particular with 4 to 8, in particular 4 or 5 carbon atoms, are preferred. Examples are diethyl carbonate, methyl ethyl carbonate; dipropyl carbonate, diisopropyl carbonate, dibutyl carbonate, diisobutyl carbonate. For example, propylene carbonate (4-methyl-1,3-dioxolane-2-on), 2,3-butylene carbonate (4,5-dimethyl-1,3-dioxolane-2-on), or 1,2-butylene carbonate (4-ethyl-1,3-dioxolane-2-on), hexahydro-1,3-benzodioxole-2-on, or 1,3-benzodioxole-2-on can be used as cyclic, organic carbonates, wherein propylene carbonate is preferably used.

The organic cyclic carbonate can be added as additive to the polyurea grease during the production, but preferably after complete formation of the thickener system in the cool-down phase.

The lubricant grease compositions according to the invention furthermore contain common additives against corrosion, oxidation, and to protect against metal influences, which act as chelate compounds, free radical scavengers, reaction layer creators, and the like. Additives, which improve the hydrolysis resistance of ester base oils, such as, e.g., carbodiimides or epoxides, can also be added.

Common additives in terms of the invention are antioxidants, wear protection agents, corrosion protection agents, detergents, dyes, lubricity promoters, adhesion promoters, viscosity additives, friction reducers, high pressure additives, and metal deactivators. Mentioned as examples are:

- primary antioxidants, such as amine compounds (e.g., alkylamine or 1-phenylamino naphthalene), aromatic amines, such as, e.g., phenyl naphthylamines or diphenyl amines, or polymeric hydroxyquinolines (e.g., TMQ), phenol compounds (e.g., 2.6-di-tert-butyl-4-methylphenol), zinc dithiocarbamate, or zinc dithiophosphate;
- secondary antioxidants, such as phosphites, e, g. tris(2,4-ditert-butylphenylphosphite) or bis(2,4-ditert-butylphenyl)-pentaerythritoldiphosphite, or thioether (e.g., cresol thioether);
- high pressure additives and/or wear protection additives, such as sulfur or organic sulfur compounds, such as, e.g., polysulfides or sulfurized olefines, overbased calcium sulfonates, thiophosphates, phosphor compounds, such as, e.g., amine neutralized alkyl phosphates;
- inorganic or organic boron compounds, zinc dialkyldithiophosphate, organic bismuth compounds; thiophosphonates, such as, e.g., triphenyl thiophosphate, phosphonates (phosphites), such as, e.g., dioctyl phosphonate, alkyl sulfonates, thiocarbamates, such as, e.g., methylene-bis(dibutyldithiocarbamates and dithiocarbamates.
- Active ingredients improving the "oiliness", such as C2 to C6 polyols, fatty acids, fatty acid esters, or animal or vegetable oils;
- anticorrosion agents, such as sulfonates, such as, e.g., petroleum sulfonate, dinonylnaphtalene sulfonate, or sorbitan ester; neutral or overbased calcium sulfonates, magnesium sulfonates, sodium sulfonates, calcium and sodium naphthalene sulfonates, sulfonic acid esters, disodium sebacate, calcium salicylates, amine phosphates, succinates;
- metal deactivators, such as benzotriazoles, such as, e.g., methylbenzotriazoldialkylamine, sterically hindered phenols, sodium nitrite; viscosity improvers, such as, e.g., polymethacrylate, polyisobutylene, oligo Dec-1-ene, polystyrenes;
- friction reducers partially with wear protection properties, such as organomolybdenum complexes (OMC), molybdenum-di-alkyl-dithiophosphates, molybdenum-di-alkyl-dithiocarbamates, in particular molybdenum-di-n-butyldithiocarbamate, and molybdenum-di-alkyl-dithiocarbamate ($Mo_{2m}S_n$(dialkylcarbamate)$_2$ with m=0 to 3 and n=4 to 1), zinc dithiocarbamate or zinc dithiophosphate;
- or a trinuclear molybdenum compound corresponding to the formula $$Mo_3S_kL_nQ_z,$$

in which L are independently selected ligands, which have organo groups with carbon atoms, as they are disclosed in U.S. Pat. No. 6,172,013 B1, in order to make the compound to be soluble or dispersible in the oil, wherein n reaches from 1 to 4, k from 4 to 7, Q is selected from the group of neutral electron donor compounds, consisting of amines, alcohols, phosphines, and ethers, and z lies in the range of 0 to 5 and comprises non-stoichiometric values (see DE 102007048091); organic acids, such as, e.g., isostearic acid, functional polymers, such as, e.g., oleylamides, organic compounds based on polyether and amide, e.g. alkylpolyethylene glycol tetradecylene glycol ether, PIBSI (polyisobutylene succimide) or PIBSA (polyisobutylene succinic anhydride), partial glycerides, dialkyl hydrogen phosphonates, alkyl succinates.

The polyurea grease compositions are in particular structured as follows:

a) 55 to 95% by weight, in particular 70 to 90% by weight, of the base oil;
b) 1 to 20% by weight, in particular 1.5 to 15% by weight, of the polyurea thickener;
c) 0.1 to 10% by weight, in particular 0.2 to 5% by weight, particularly preferably 0.5 to 2% by weight, of the organic carbonates;

and of the following optional components:

d) 0.5 to 40% by weight, in particular 2 to 10% by weight, of additives;
e) 0 to 20% by weight, in particular 0 to 5% by weight, of inorganic thickeners, such as amorphous $SiO_2$ or silicic acid; and
f) 0 to 20% by weight, in particular 0.1 to 15% by weight, of solid lubricants
g) 0 to 20% by weight, in particular 1 to 15%, of further organic thickeners, in particular soap or complex soap thickeners, on the basis of calcium, lithium, or aluminum soaps in addition to possible further components, such as lignin derivatives.

The % by weight specifications refer to the total composition and in each case apply independently of one another. A constituent, which is assigned to one of the groups a), b), c), or d), cannot be a constituent of another group a) to d) at the same time. The % by weight specifications for each selection of components, including possible optional components not mentioned above, add up to 100% by weight.

The thickening agent is used in particular so that the composition contains so much thickening agent that a cone penetration value (worked penetration) from 220 to 430 mm/10 (at 25° C.), preferably 265 to 385 mm/10, is obtained (determined according to DIN ISO 2137).

The polyurea in the polyurea grease composition is generally produced by means of in-situ reaction of the above-mentioned amines and isocyanates, preferably in the base oil.

According to the method for producing the polyurea grease composition, on which the present invention is based, a precursor (base grease) is initially created by means of merging of at least base oil and amine and isocyanate components and heating to above 120° C., in particular above 150° C., to produce the base grease, cool-down of the base grease and addition of the additives, preferably at below 100° C. or even below 80° C.

If a further thickening component is added to the polyurea base grease, such as the soap or complex soap thickener, this takes place, for example, after the production of the base grease during the cool-down curve at a suitable temperature (e.g., at 140 to 115° C. addition of the soap or complex soap thickener, in particular the Ca soap or the Ca complex soap, respectively).

For the production of the base grease, a heat-up to temperatures of above 120° C. or preferably greater than 150° C. occurs. The conversion to the base grease takes place in a heated reactor, which can also be formed as autoclave or vacuum reactor.

The formation of the thickener structure is subsequently completed in a second step by means of cool-down, and further constituents, such as additives and/or base oil are optionally added to set the desired consistency or the desired property profile. The second step can be performed in the reactor of the first step, but the base grease is preferably transferred from the reactor into a separate stirring tank for cool-down and mix-in of the optional further constituents.

What applies for pure polyurea greases can also be transferred to mixed thickener systems with polyurea thickener portion. The production of polyurea greases with lime soap portion (simple and complex soaps of hydroxy monocarboxylic acids, e.g., 12-hydroxy stearic acid) is disclosed, e.g., in U.S. Pat. No. 5,084,193. The method of U.S. Pat. No. 5,084,193 can also be used to produce the polyurea greases according to the invention.

The lubricating greases according to the invention are particularly suitable for the use in or for sliding bearings, ball bearings, gearboxes, or also constant velocity drive shafts. The lubricating greases according to the invention, containing mainly polyurea thickeners as thickeners, are particularly suitable as high-temperature greases It is a particular aspect of the present invention to provide a lubricating grease, which is compatible with sealing materials made of fluorinated elastomers. The selection of fluorinated elastomers as materials for seals of a large variety of constructions if often specified by the conditions of use, such as, for example, high temperature and/or chemically aggressive media because these materials have an extraordinary resistance against heat, weather conditions, and numerous chemicals.

Fluororubbers (often abbreviated as FKM or FPM) belong to the class of the fluorinated elastomers. For crosslinking purposes, for example diamine, bisphenol, or peroxide crosslinking, are used as a function of the desired fluoroelastomer properties. Rubbers, which have vinylidene(di)fluoride (VDF) as common feature as one of their monomers, are referred to as fluororubbers. The two most important types of fluororubbers are copolymers of vinylidene fluoride (VDF), and hexafluoropropylene (HFP), and terpolymers of VDF, HFP, and tetrafluorethylene (TFE). Typical commercial products for fluororubbers are sold under the trademarks Viton®, Tecnoflon®, Dyneon®, or Dai-El®.

In addition, there are also polymers of VDF, HFP, TFE, and perfluormethylvinylether (PMVE), polymers of VDF, TFE, and propene, as well as polymers of VDF, HFP, TFE, PMVE, and ethers.

In addition to the fluororubbers, further groups of fluorinated elastomers exist, such as, e.g., perfluorinated rubber (FFKM), tetrafluorethylene/propylene rubbers (FEPM), and fluorinated silicon rubbers (FVMQ).

The sealing materials are used in the form of or as part of seals at the lubrication points, where the polyurea grease is used. Seals are a broadly differentiated class of important construction elements.

On principle, a division can be made into static and dynamic sealing points. Lubrication is necessary in particular in the case of moved parts, so that the seals often refer to dynamic sealing points. However, the static housing seal, e.g., of gearboxes as leakage protection is likewise included as example for static seals.

The seals are formed, e.g., as O-rings or profile rings, radial shaft seal, sliding ring seal, gland seal, flat seal, lip seal, wiper, sealing cords. Here, examples for applications are radial shaft seals for generator shafts, gland seals for pumps, sliding ring seals for chemical reactors or bead mills (sealing of the agitator shaft), shaft seals in driers, screw conveyors and conveyor belts, sealing elements for hydraulic and pneumatic systems (presses, construction vehicles, etc.), and seals for ball bearings and sliding bearings.

The invention will be described below by means of examples, without being limited to them. The details of the examples and the properties of the lubricating greases are shown in the following Tables 1 to 5.

Example 1: Production of the Greases B1-A to B1-C 630 g of group II oil (hard hydrogenated, paraffinic; 105-110 cSt at 40° C.) were provided in a heatable reaction vessel comprising an agitator. 113.4 g of 4,4-methylene-bis-diphenyldiisocyanate were added to this and the content of the reaction vessel was heated to 60° C. by means of stirring. 630 g of PAO 8 were provided in a further heatable vessel comprising an agitator, and 87.6 g of p-toluidine as well as 9.0 g of cyclohexylamine were added. The content of the vessel was heated to 60° C. The content of this vessel was transferred into the reaction vessel with dissolved isocyanate. The thickener was formed in an exothermal reaction. The thickener-oil mixture was then heated to a final temperature of 160° C. over the course of 2 hours. After cool-down of the reaction mixture to a temperature of 100° C., 15.0 g of Irganox L101 as well as 15.0 g of Irganox L115 were added. The mixture was cooled down to 60° C. and was mixed with the desired quantity of propylene carbonate (0-1% by weight). Lastly, the lubricating grease was homogenized by means of a colloid mill.

TABLE 1

| Name | B1-A | B1-B | B1-C |
|---|---|---|---|
| Propylene carbonate | 0% | 0.5% | 1.0% |
| Δ Shore A | +15 | +11 | +2 |

TABLE 1-continued

| Name | B1-A | B1-B | B1-C |
|---|---|---|---|
| Δ weight | +1.2% | +1.3% | +1.1% |
| Δ volume | +3.2% | +2.8% | +0.9% |

Example 2: Production of the Greases B2-A to B2-C 1305.0 g of group I oil (mineral oil, paraffinic; 110 cSt at 40° C.) were provided in a heatable reaction vessel comprising an agitator, and 88.5 g of 4,4-methylene-bis-diphenyldiisocyanate were added to this. The content of the reaction vessel was heated to 60° C. by means of stirring. Then, 91.5 g of drops of n-octylamine were added to the content of the reaction vessel. An exothermal reaction with formation of the thickener took place. The reaction mixture was heated to a final temperature of 160° C. within 2 hours by means of stirring and was then cooled down to 60° C. The desired quantity of propylene carbonate (0-1% by weight) was then added and, lastly, the grease was homogenized via a colloid mill. The properties of the obtained polyurea grease are compiled in Table 2.

TABLE 2

| Name | B2-A | B2-B | B2-C |
|---|---|---|---|
| Propylene carbonate | — | 0.5% | 1% |
| Δ Shore A | +13 | +7 | +3 |
| Δ weight | +3.6% | +1.6% | +1.9% |
| Δ volume | +8.2% | +3.4% | +5.0% |

Example 3: Production of the Greases B3-A to B3-C 369.7 g of group I oil (paraffinic; 480 cSt at 40° C.) as well as 567.2 g of group II oil (hard hydrogenated, paraffinic; 105-110 cSt at 40° C.) were provided in a heatable reaction vessel comprising an agitator.

94.2 g of 4,4-methylene-bis-diphenyldiisocyanate were added to this and the content of the reaction vessel was heated to 60° C. by means of stirring. Then, a mixture of 37.3 g of drops of cyclohexylamine as well as of 47.8 g of n-octylamine were added, in response to which the formation of the thickener takes place exothermally. The reaction mixture was heated to a final temperature of 160° C. within 2 hours by means of stirring. Upon reaching the final temperature of 160° C., additional 300.0 g of group II oil (hard hydrogenated, paraffinic; 105-110 cSt at 40° C.) were added and the reaction mixture was then cooled down to 130° C. and 44.8 g of calcium-12-hydroxystearate were added. The temperature of 130° C. was held for 30 minutes. The reaction mixture was then cooled down to 110° C., 7.5 g of a phenolic antioxidant (Irganox L115) as well as 31.5 g of inorganic filler were added. After cool-down to 60° C., the desired quantity of propylene carbonate (0-1% by weight) was added. An additive package consisting of aminic antioxidants, high-pressure additives, AW additives, nonferrous metal passivator as well as corrosion protection additives were then added and, lastly, the grease was homogenized via a triple roll mill.

The properties of the obtained polyurea grease containing calcium soap are compiled in Table 3. The drop point was determined according to DIN ISO 2176.

TABLE 3

| | B3-A | B3-B | B3-C |
|---|---|---|---|
| Propylene carbonate | 0% | 0.3% | 1% |
| RP-SF | 253 | 281 | 273 |
| RP-24 h | 233 | 239 | 242 |
| WP60 | 272 | 289 | 286 |
| WP60000 | 285 | 304 | 294 |
| ΔP 60-60000 | 13 | 15 | 8 |
| Drop point | 272.7° C. | 270.0° C. | 264.2° C. |
| Δ Shore A | +8 | +4 | +1 |
| Δ weight | +1.7% | +1.6% | +1.7% |
| Δ volume | +2.6% | +0.6% | +2.6% |

Determination of the Compatibility with Fluorinated Elastomers

The determination of the compatibility of the polyurea greases with fluorinated elastomers takes place by means of a vinylidene fluoride hexafluoropropylene copolymer (type: SRE-FKM/2X according to DIN ISO 13226). For this purpose, test specimens with a diameter of 30 mm and a thickness of 2 mm were punched out of an elastomer sheet of SRE-FKM/2X. The test specimens were immersed in the above-described polyurea greases at 180° C. or 160° C., respectively, for 7 days and were then evaluated.

The evaluation of the fluorinated elastomers took place after wiping off the grease with a clean cloth by means of:

a) determination of the penetration hardness (Shore A) according to DIN EN ISO 7619-1, wherein the test specimen had a penetration hardness (Shore A) of 78 prior to the treatment, and b) bending tests by hand.

The bending tests were performed in that the elastomer was bent over a pipe with the diameter of 3 cm and 1 cm. The elasticity of the elastomer was evaluated.

The stabilizing effect of the propylene carbonate was demonstrated in the immersion test. In spite of the high immersion temperature of 180° C., no or only very small signs of embrittlement were shown with increasing propylene carbonate content.

When using the polypropylene carbonate in the polyurea grease, the fluorinated elastomers tend to cure less or to no longer cure. According to the suggestion by the elastomer manufacturers, greases causing a hardness change of significantly more than 10 points with respect to the penetration hardness (Shore A) according to DIN EN ISO 7619-1 are considered to be incompatible with the respective elastomer.

The results are compiled in Table 4.

TABLE 4

| | Example 1 | | | Example 2 | | | Example 3 | | |
|---|---|---|---|---|---|---|---|---|---|
| | B1-A | B1-B | B1-C | B2-A | B2-B | B2-C | B3-A | B3-B | B3-C |
| Thickener-composition | MDI/p-toluidine, cyclohexylamine | | | MDI/octylamine | | | MDI/octylamine, cyclohexylamine//Ca-12-HSA | | |

TABLE 4-continued

| | Example 1 | | | Example 2 | | | Example 3 | | |
|---|---|---|---|---|---|---|---|---|---|
| | B1-A | B1-B | B1-C | B2-A | B2-B | B2-C | B3-A | B3-B | B3-C |
| Propylene carbonate [% by weight] | 0 | 0.5 | 1 | 0 | 0.5 | 1 | 0 | 0.3 | 1 |
| Temperature [° C.] | | 180 | | | 180 | | | 160 | |
| Δ Shore A | +15 | +11 | +2 | +13 | +7 | +3 | +8 | +4 | +1 |
| Bending test by hand of the fluorinated elastomer test specimen | Cured | somewhat flexible | soft, flexible | brittle, breaks when bent | somewhat flexible | flexible | brittle breaks when bent | still flexible | flexible |

With the addition of 0.5% of propylene carbonate in the grease B2-B, the increase of the hardness of the FKM elastomer was halved. With the addition of 1% of propylene carbonate (B2-C), the increase was reduced to harmless 3 points with respect to the penetration hardness (Shore A) according to DIN EN ISO 7619-1.

Given the fact of a maximally admissible hardness change of 10 points (penetration hardness (Shore A) according to DIN EN ISO 7619-1), the comparative grease B3-A shows a marginal result (+8). By adding 0.3% of propylene carbonate (B3-B), the hardness change was already pushed back into a harmless range. By adding 1% of propylene carbonate (B3-C), the elastomer remained virtually unchanged with respect to its hardness change.

Example 4A and 4B

In addition to the improved compatibility of the polyurea grease composition with fluorinated elastomers, the useful properties with respect to the period of use and the post-curing behavior can be improved with the addition of the carbonates. 875.0 grams of group I oil (paraffinic; 105-110 cSt at 40° C.) as well as 875.0 g of group II oil (hard hydrogenated, paraffinic; 105-110 cSt at 40° C.) were each provided in a heatable agitator. 31.5 grams of 4,4-methylene-bis-diphenyldiisocyanate (MDI) was added to this oil mixture. The reactor content was heated to 55° C. by means of stirring. At 55° C., a mixture of 12.5 grams of cyclohexylamine as well as 16.0 grams of N-octylamine were metered in slowly. Due to the exothermal reaction of isocyanate with the amine mixture, the temperature increased to 72° C. This temperature was held for 30 minutes, in order to complete the formation of the thickener. By constant stirring, the reaction mixture was heated to a final temperature of 160° C. within 3 hours. The reactor content was subsequently cooled down to 135° C., followed by the addition of 180.0 grams of calcium-12-hydroxystearate. The mixture was stirred for 30 minutes at consistent temperature. The batch was cooled down to 60° C. by means of further stirring, followed by the addition of 10.0 grams of an aminic antioxidant (Irganox L57). The base grease batch was then divided into part A and B. Part B was transferred into a planetary mixer, 0.5% of propylene carbonate were added at 25° C. and were mixed for 15 minutes.

Both partial batches A and B were subsequently homogenized by means of a colloid mill: example 4A: without propylene carbonate/example 4B: with 0.5% by weight of propylene carbonate

Example 4C 875.0 grams of group I oil (paraffinic; 105-110 cSt at 40° C.) as well as 875.0 g of group II oil (hard hydrogenated, paraffinic; 105-110 cSt at 40° C.) were each provided in a heatable agitator. 31.5 grams of 4,4-methylene-bis-diphenyldiisocyanate (MDI) was added to this oil mixture. The reactor content was heated to 55° C. by means of stirring. At 55° C., a mixture of 12.5 grams of cyclohexylamine as well as 16.0 grams of N-octylamine was metered in slowly. Due to the exothermal reaction of isocyanate with the amine mixture, the temperature increases to 72° C. This temperature was held for 30 minutes, in order to complete the formation of the thickener. The reaction mixture was heated to a final temperature of 160° C. within 3 hours by means of constant stirring.

The reactor content was subsequently cooled down to 135° C., followed by the addition of 180.0 grams of calcium-12-hydroxistearate. The mixture was stirred for 30 minutes at consistent temperature. At 135° C., the addition of 20.0 grams (1.0%) of propylene carbonate takes place by means of stirring. The batch was subsequently cooled down to 80° C. and 10.0 grams of an aminic antioxidant (Irganox L57) was added. The batch was subsequently ground by means of a colloid mill. The obtained characteristic values are compiled in Table 5 below.

TABLE 5

| Name | Example 4 A | Example 4 B | Example 4 C |
|---|---|---|---|
| Propylene carbonate [% by weight] | 0 | 0.5 | 1.0 |
| Temperature at addition of the propylene carbonate | 25° C. | 25° C. | 135° C. |
| RP-SF/DIN ISO 2137 | 296 | 306 | 293 |
| RP-24 h at 25° C./DIN ISO 2137 | 283 | 287 | 269 |
| RP-24 h at 100° C./DIN ISO 2137 | 215 | 221 | 225 |
| ΔRP-24 h (25° C. v. 100° C.) | −68 | −66 | −44 |
| WP60 at 25° C./DIN ISO 2137 | 301 | 311 | 302 |
| WP60000/DIN ISO 2137 | 327 | 329 | 328 |
| Δ60-60000 | 26 | 18 | 26 |
| WP60-24 h at 100° C./DIN ISO 2137 | 283 | 302 | 305 |
| ΔWP 60 (25° C. v. 100° C.) | −18 | −9 | +3 |
| Drop point [° C.]/DIN ISO 2176 | 207.9 | 207.3 | 200.7 |
| Oil separation at 40° C., 18 h DIN 51817 FE9 according to DIN 51821 Installation type B, 140° C. | 1.6% | 1.6% | 1.7% |
| F10 | 9 h | 45.8 h | 63.2 h |
| F50 | 44 h | 117.5 h | 92.8 h |

By adding organic carbonates, a slight consistency softening of the worked penetration WP60 is attained. The drop point of the greases is lowered slightly by adding propylene carbonate, whereas the oil separation remains at the same level.

A significant difference can be observed with the post-curing behavior at increased temperature (100° C.) compared to 25° C.: the static penetration of grease samples, which were stored for 24 hours (RP-24 h) at 100° C., decreases strongly compared to those, which were stored for 24 h at 25° C., the greases post-cure (see ΔRP-24 h). With the addition of 1% of propylene carbonate, this post-curing effect was reduced by approximately 30%.

A similar picture can be observed during the post-curing at temperature (100° C.) during the worked penetration WP60. By adding 1% of propylene carbonate, the post-curing of a grease sample stored for 24 hours at 100° C. and then cooled down to 25° C. can be completely avoided compared to a grease sample stored at 25° C. during the worked penetration WP60 (see the WP60-24 h values), whereas greases without propylene carbonate showed a significant post-curing.

The FE9-test of the greases reveals a further advantage of the organic carbonates. In the case of the example greases 4B and 4C, the downtimes F10 and F50 were improved by more than 50% by adding propylene carbonate.

The invention claimed is:

1. A polyurea grease composition comprising:
a) at least one base oil;
b) at least one polyurea thickener; and
c) at least one organic carbonate, wherein the organic carbonate comprises 4 to 8 carbon atoms,
wherein the composition comprises:
a) 55 to 95% by weight of the base oil;
b) 1 to 20% by weight of the polyurea thickener;
c) 0.1 to 10% by weight of the organic carbonate and
d) 0.5 to 10% by weight additives.

2. The polyurea grease composition according to claim 1, wherein the composition comprises:
a) 70 to 90% by weight of the base oil;
b) 1.5 to 15% by weight of the polyurea thickener; and
c) 0.2 to 5% by weight of the organic carbonate.

3. The polyurea grease composition according to claim 1, wherein the composition furthermore comprises:
a) 2 to 10% by weight additives;
b) 0 to 20% by weight inorganic thickeners; and
c) 0 to 20% by weight solid lubricants.

4. The polyurea grease composition according to claim 1, wherein the composition furthermore comprises:
a) 0 to 20% by weight of a further organic thickener, wherein the further organic thickener is a soap or a complex soap based on a calcium soap, a lithium soap, or an aluminum soap.

5. The polyurea grease composition according to claim 1, wherein the composition contains no bentonites, no aluminosilicates, no aluminum oxides, no silicic acids, and no amorphous silicon dioxide.

6. The polyurea grease composition according to claim 1, wherein the organic carbonate is a cyclic carbonate.

7. The polyurea grease composition according to claim 1, wherein the composition has a cone penetration value for worked penetration of 220 to 430 mm/10 at 25° C. determined according to ISO 2137.

8. The polyurea grease composition according to claim 1, wherein the base oil has a kinematic viscosity of 20 to 2500 $mm^2/s$ at 40° C.

9. A lubrication point comprising the polyurea grease composition according to claim 1, and a seal comprising a sealing material, wherein the sealing material consists of an elastic fluoropolymer.

10. A component comprising
a) at least one lubrication point,
b) a seal, comprising a sealing material, wherein the sealing material consists of an elastic fluoropolymer, and
c) the polyurea grease composition according to claim 1 in contact with the lubrication point and the seal.

11. The component according to claim 10, wherein the elastic fluoropolymer is a fluororubber elastomer.

12. The component according to claim 10, wherein the seal is an O-ring or profile ring, a radial shaft seal, a sliding ring seal, a gland seal, a flat seal, a lip seal, a wiper, or a sealing cord.

13. The component according to claim 10, wherein the component is a shaft, a gearbox, a piston, a joint, a ball bearing, or sliding bearing.

14. A method for producing the polyurea grease composition according to claim 1 method comprising producing a polyurea in at least one portion of the base oil while heating, and adding the organic carbonate after producing the polyurea in the base oil and during cool-down to a temperature of between 100° to 135° C.

15. The polyurea grease composition according to claim 1, wherein the composition comprises:
a) 70 to 90% by weight of the base oil;
b) 1.5 to 15% by weight of the polyurea thickener; and
c) 0.5 to 2% by weight, of the organic carbonate.

16. The polyurea grease composition according to claim 1, wherein the composition furthermore comprises:
0 to 5% by weight inorganic thickeners; and
0.1 to 15% by weight solid lubricants.

17. The polyurea grease composition according to claim 1, wherein the composition furthermore comprises:
1 to 15% of a further organic thickener, wherein the further organic thickener is a soap or a complex soap based on a calcium soap, a lithium soap, or an aluminum soap.

18. The polyurea grease composition according to claim 1, wherein the composition contains no inorganic thickener.

19. The polyurea grease composition according to claim 1, wherein the organic carbonate is propylene carbonate.

20. The polyurea grease composition according to claim 1, wherein the composition has a cone penetration value for worked penetration of 265 to 385 mm/10 at 25° C. determined according to ISO 2137.

21. The polyurea grease composition according to claim 1, wherein the base oil has a kinematic viscosity of 40 to 500 $mm^2/s$ at 40° C.

22. The lubrication point according to claim 9, wherein the elastic fluoropolymer is a fluororubber elastomer.

23. The lubrication point according to claim 9, wherein the seal is an O-ring or profile ring, a radial shaft seal, a sliding ring seal, a gland seal, a flat seal, a lip seal, a wiper, or a sealing cord.

* * * * *